US010357141B2

(12) United States Patent
Kingma et al.

(10) Patent No.: US 10,357,141 B2
(45) Date of Patent: Jul. 23, 2019

(54) FLOOR CLEANING DEVICE

(71) Applicant: KONINKLIJKE PHILIPS N.V., Eindhoven (NL)

(72) Inventors: Pieter Kingma, Eindhoven (NL); Matthijs Hendrikus, Eindhoven (NL); Mark Van Wijhe, Eindhoven (NL); Wiebe Wierda, Eindhoven (NL); Paulus Cornelis Duineveld, Eindhoven (NL); Stephanus Jacob Gerardus Tamminga, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/519,167

(22) PCT Filed: Oct. 19, 2015

(86) PCT No.: PCT/EP2015/074101

§ 371 (c)(1),
(2) Date: Apr. 14, 2017

(87) PCT Pub. No.: WO2016/062649

PCT Pub. Date: Apr. 28, 2016

(65) Prior Publication Data

US 2017/0231454 A1 Aug. 17, 2017

Related U.S. Application Data

(60) Provisional application No. 62/066,506, filed on Oct. 21, 2014, provisional application No. 62/065,950, filed on Oct. 20, 2014.

(30) Foreign Application Priority Data

Feb. 3, 2015 (EP) ..... 15153562

(51) Int. Cl.
*A47L 13/22* (2006.01)

(52) U.S. Cl.
CPC ..... *A47L 13/22* (2013.01)

(58) Field of Classification Search
CPC ..... A47L 13/22
(Continued)

(56) References Cited

U.S. PATENT DOCUMENTS 2,307,858 A 1/1943 Arthur
2,601,689 A * 7/1952 Mallard ..... A47L 13/312 15/231

(Continued)

FOREIGN PATENT DOCUMENTS

EP 0308032 A 3/1989
JP 10015838 Y 10/1935

(Continued)

*Primary Examiner* — David J Walczak
*Assistant Examiner* — Joshua R Wiljanen

(57) ABSTRACT

A liquid containing system for a floor cleaning device, the liquid containing system comprising an outlet having a plurality of openings (H) to allow a liquid (W) to be extracted by means of capillary force when a mopping substrate, e.g. a cloth (C), is mounted against the plurality of openings (H), after filling the liquid containing system being substantially closed but for the plurality of openings (H).

11 Claims, 2 Drawing Sheets

(58) Field of Classification Search
USPC ..... 401/199, 266, 282, 283, 156, 157, 190
See application file for complete search history.

(56) References Cited

U.S. PATENT DOCUMENTS

| | | | | |
|---|---|---|---|---|
| 3,258,809 | A | 7/1966 | Harmond | |
| 4,594,015 | A * | 6/1986 | Pomares | A46B 11/0041 401/139 |
| 7,820,277 | B2 | 10/2010 | Bando | |
| 8,596,896 | B2 | 12/2013 | Kimura | |
| 8,898,844 | B1 * | 12/2014 | Dooley | A47L 11/10 15/319 |
| 2002/0018687 | A1 * | 2/2002 | Owings | A45D 34/04 401/6 |
| 2005/0152737 | A1 | 7/2005 | Tien | |
| 2010/0104353 | A1 * | 4/2010 | Wang | A46B 11/06 401/283 |

FOREIGN PATENT DOCUMENTS

| | | | |
|---|---|---|---|
| JP | 49006290 | U1 | 1/1974 |
| JP | 58224635 | A | 12/1983 |
| JP | 0591550 | U1 | 12/1993 |
| JP | 3031052 | U | 8/1996 |
| JP | 08290087 | A | 11/1996 |
| JP | 09098920 | A | 4/1997 |
| JP | 2001309881 | A | 11/2001 |
| JP | 2011147832 | A | 8/2011 |
| WO | 2009096500 | A1 | 8/2009 |
| WO | 2014074716 | A1 | 5/2014 |

* cited by examiner

FLOOR CLEANING DEVICE

This application is the U.S. National Phase application under 35 U.S.C. § 371 of International Application No. PCT/EP2015/074101, filed on Oct. 19, 2015, which claims the benefit of Provisional Application Nos. 62/065,950 filed on Oct. 20, 2014 and 62/066,506 filed on Oct. 21, 2014 and International Application No. 15153562.2 filed on Feb. 3, 2015. These applications are hereby incorporated by reference herein.

FIELD OF THE INVENTION

The invention relates to a floor cleaning device, and in particular to a liquid containing system for the floor cleaning device.

BACKGROUND OF THE INVENTION

There are nowadays more and more products that compete with the old-fashioned mop and bucket. Many companies see possibilities to gain a piece of this huge market for wet floor/surface cleaning. In general, these products can be divided in three groups: the bucket and mops (with and without wringers), pre-wetted cloths or so called "quickie wiper" (non-woven cloths like Swiffer wet), and electrically driven floor scrubbers.

What these products have in common is that they all wet the floor with a certain amount of liquid. Wetting the floor is needed for removing the stains from the floor but it also gives a kind of shininess to the floor. This is the main feedback for the consumers that the floor is well cleaned. The amount of water is critical for the key performance indicators: cleaning performance, shininess, drying time and floor damage.

A main disadvantage of the bucket and mop principle is that the amount of water on the floor is difficult to control. It strongly depends on how well the mop is wrung. Some buckets have a mechanical system that helps to wring the mop. Still the amount of water on the floor depends on the force the consumer puts on the wringer and also depends on the amount of force that is put on the mop by the consumer during cleaning the floor. This can result in a poor cleaning performance when the mop is too dry but even worse, it can result in damage to the floor when the mop is too wet.

Pre-wetted cloths do solve this problem but another, maybe even bigger problem occurs. Due to the fact that the pre-wetted cloths can only contain a very little amount of water, the surface area that can be cleaned is very limited, the cloth is drying out too fast. This is also the biggest complaint of the consumer who buys these products. There are several products in the market that try to solve this issue by adding a reservoir and a spray nozzle to the appliance. In this case the user can spray a certain amount of liquid to the floor when he notices that the cloth is too dry. Whether this solution is sufficient depends again strongly on the user. Another disadvantage is that it is not a continuous operating system. The trigger for using it is when the performance is already low. Concluding: all manually operated devices have a high variation in wetness on the floor.

Electric driven floor scrubbers mainly use electric pumps or dosing systems. Apart from the fact that this solution is rather expensive, these systems are very vulnerable for pollution/clogging and in common these pumps are not chemical resistant which is a big issue when detergents are being used. Most pumps use electric power and therefore apart from interfaces to reservoirs and water distributing provisions they need an interface to the electric circuit.

Efforts have also been made to supply sponge mops continuously and evenly with liquids by providing a dosing mechanism, in many cases having a plurality of substantially evenly spaced openings which feed fluid into the sponge. The two primary disadvantages are that these substantially evenly spaced openings become clogged with dirt or other residue and that due to the fact that the amount of liquid which is needed to wet the floor is very limited (1~6 g/m$^2$), it is very difficult to control the liquid emission, taking the different operating speeds of the device into account.

An in-depth analysis of detergents shows that many detergents react with the calcium in the water and will form a so called soap scum. Soap scum are small particles in the range of 5~30 micron that float in the water. Those particles can easily block small holes/pores/openings in the liquid dosing mechanism. Test shows that holes larger than 0.3 mm no longer clog due to residue or soap scum in normal daily use.

Test shows that a normal flat mop leaves approximately 3~6 g liquid on 1 m$^2$ floor at a normal working speed of 5~10 m$^2$ per minute. That means on average a water flow of 35 ml/min.

To define the size of the opening for the liquid to flow, a simple calculation shows that with an open reservoir filled with a 5 cm water column height and just 1 hole, the diameter should be ~1 mm ($Q=A \text{ sqrt } ((g*h)/K)$). In this formula, Q is flow, A is area of the opening, g is gravity, h is height of the water column, and K is a resistance constant. This formula was used and values were substituted to show the correlation among the above mentioned parameters.

To have an evenly distribution of the liquid on to the mop, just 1 hole is not sufficient. It is obvious that for the number of holes, the more the better counts. But this also means that the diameter of the holes needs to get smaller to get the same flow.

If holes of 0.3 mm are used (good diameter to prevent clogging in normal daily use), just 10 holes can be used to wet the pad. This will not give an evenly distributed water film on the floor.

For a small mop with a width of 250 mm and the holes spaced apart at 5 mm, it means 45 holes are needed. For the same flow of 35 ml/min with 45 holes we need holes of 0.15 mm. Such holes are too small to prevent clogging.

Another disadvantage of such a system is that the water flow strongly depends on the water column height in the reservoir (see above equation). This means that the user has more water on the floor with a just filled appliance and less water after several minutes of use. If also the difference in working speed of the user is taken into account which means if user moves half the speed the appliance gives double amount of water on the floor, it shows that the appliance is not robust and delivers an unpredictable result.

There are systems that make use of a wick e.g. iRobot. All wick systems have a generic disadvantage. The liquid transport makes use of the capillary force of a wick type material (e.g. cotton or microfiber). The capillary force exists due to small pores in the wick material. One end of the wick is in contact with the liquid in the reservoir and is placed inside the reservoir partially whereas the other end is outside the reservoir and is placed in contact with a mopping cloth to transfer the cleaning liquid. As explained above, small pores will clog due to detergents and or soap scum. This means that the lifetime of such element is rather short. Some products try to overcome this problem by selling separate wicks which can be replaced by consumers. It is obvious that this is not ideal, especially when multiple wicks are used to get an even distribution of the liquid to the cloth.

SUMMARY OF THE INVENTION

It is an object of the invention to provide an improved liquid containing system for a floor cleaning device. The invention is defined by the independent claims. Advantageous embodiments are defined in the dependent claims.

One embodiment of this invention provides a system for a continuous wet cleaning device. The device comprises a reservoir for containing a liquid and possibly additives and a liquid distribution provision wherein the liquid distribution provision distributes the liquid contained in the reservoir evenly over a mopping substrate (e.g. a cloth). Preferably, this liquid distribution provision is a replaceable part in the full system. This is to make the system easily adjustable for different wetness on different floor types and extend lifetime of full system where liquid distribution provision can be replaced when clogged. Further, the cloth is placed in direct contact of the liquid distribution provision. Thus, this cloth is continuously wetted by the liquid from the reservoir while using and can be used for e.g. cleaning the floor or any surface. Furthermore, this device is semi-closed and is open to the atmosphere only on the lower side and has a liquid fill opening placed suitably on the device body.

Another embodiment of this invention provides a method to distribute a certain amount of water on the floor with a good balance between the key performance indicators.

Best solution is to use the cleaning cloth also as the "wick" to transport the water out of the reservoir. In that case the cloth/wick is washed after every use and clogging is no issue. One of the main issues that need to be solved is the even distribution of liquid over the cloth.

As shown above, a gravity feed dosing system will end up with too small holes that clog or will have a too low number of holes to have an evenly distributed water film on the floor.

In a main embodiment of this invention, it is that not gravity will force water out of the reservoir but the force is the capillary pull/suction from the cloth to get water out of the reservoir. This can be obtained by making the upper part of the reservoir airtight and covering the holes for the water distribution in the lower part with a cloth. By making the reservoir airtight, water will not run out because no air can replace the volume of the water which wants to run out. The pressure in the reservoir will be lower than the ambient pressure. There is a relation between water column height and diameter of the hole. When the water column gets too high, the force to push the water out gets higher than the under pressure which prevents to let the water out and this will result in water dripping out until the water column height is in balance with the hole size. This gives limitations to the height of the reservoir. When the holes are too big, air will pass too easily via the holes inside the appliance, and the appliance will start dripping. In other embodiments, there may be a small hole, or a hole with a valve, and/or a membrane as will be further disclosed below. So, the notion "substantially closed" does not necessarily mean that the system is fully closed but for the openings from which liquid is supplied to the mopping substrate; there may be a limited number of small openings allowing air to enter the reservoir.

To get the water out of the airtight (upper part) reservoir, the holes (lower part) are covered by a mop/cloth material that absorbs water. The cloth will absorb the water out of the reservoir and generate an under-pressure in the reservoir. When the under-pressure exceeds a certain threshold, air will be sucked in via the holes in the lower part. In principle the suction of the cloth continues until the cloth is saturated with the liquid. When the system is now moved on the floor for e.g. cleaning, the water from the cloth will be transferred to the floor. This means the cloth will not saturate and will keep generating an under-pressure and will keep absorbing water out of the reservoir. Referring to FIGS. 1 and 2, a closed system has small holes in a lower part and covered with cloth. Water is sucked out of reservoir due to capillary forces of cloth.

The transfer of water from the reservoir to the cloth depends on the type of cloth and the dimensions of the holes, such as hole diameter/size and shape. The transfer of water from the cloth to the floor depends on the cloth, the saturation of the cloth and the floor. Certain cloth properties are for example: the number of fibers, the type of fibers (e.g. microfiber) and capillary force. Also, the water regulation can be changed by influencing the placement of holes in the base of the reservoir. The holes can all be placed in the base evenly as shown in FIG. 11 or may be placed in a manner such that height of one hole adjacent to the other is variable i.e. there is a step on which the hole is constructed and can be seen in FIG. 12. This placement of holes can influence the wettability by the fact that holes which are in the base and come in contact with the cloth help to dispense the liquid while the holes which are raised act as air vents. Also, contrary to the above, the choice and placement of the holes at varying height can be randomly arranged and need not be adjacent. For example only the first and last holes in the series of holes be designed as raised holes where as the other holes are in the base.

The cloth functions as a self-regulating system, as the cloth gets more saturated the transfer of water from the reservoir to the cloth will reduce until the cloth is fully saturated. Therefore the amount of water in the cloth will remain fairly constant, and the water on the floor (end result) is almost independent of the speed with which the user cleans the floor.

The self-regulation of the cloth is due to the capillary forces in the cloth, these forces create an under-pressure in the reservoir and are up to a magnitude of five times the pressure created by the water column in the reservoir (taking into account the water column height limitation as mentioned above). Therefore the wetness of the floor is also almost independent of the amount of water in the reservoir.

This means the system delivers an end result constant over time and independent from cleaning speed (evenly distributed wetness on the floor in $g/m^2$). Due to the interaction of the cloth between reservoir and floor the wetness level on the floor can be influenced by changing the properties of the cloth in combination with the same device (amount of holes and diameter). However, the dimensions and number of holes are the main parameter to influence the wetness. Bigger holes means less resistance to let water out, less resistance to let air in, and a bigger surface of the cloth that is in contact with the water.

For a comparison with a normal flat mop, a strip with 45 holes evenly distributed over a width of 250 mm in combination with a microfiber cloth can have holes between 0.2~0.4 mm to have 3~6 g liquid on 1 $m^2$ floor (same wetness as flat mop).

For comparison with conventional open systems, an open system needs 45 holes with a diameter of 0.15 mm, while a system in accordance with an embodiment of this invention needs 45 holes with a diameter of 0.3 mm.

This means that the diameters of holes are doubled and therefore will not clog due to residue or soap scum. Phrased in other words, the surface area that might clog is 4 times bigger than in a conventional system with the same number of holes.

A very practical advantage of the described closed system is that the system starts wetting when cloth is placed. An open system starts dripping as soon water is inside the reservoir. This is unwanted during filling etc. Another practical advantage is that during pausing/short parking the water pull is decreasing as the floor is already wet, resulting in a decreasing flow which prevents the system from leaking further resulting in a puddle of water.

These and other aspects of the invention will be apparent from and elucidated with reference to the embodiments described hereinafter.

DESCRIPTION OF EMBODIMENTS

Figure 1:
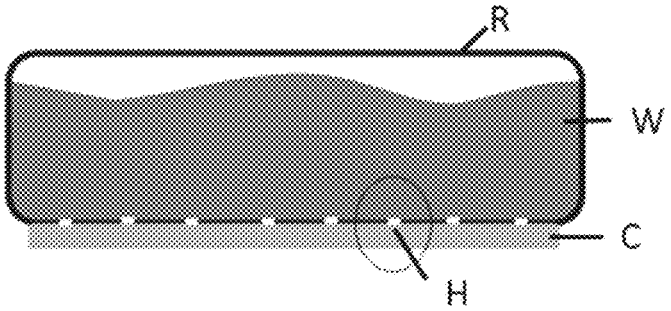
FIGS. 1 and 2 illustrate a first embodiment in accordance with the present invention.
Figure 2:
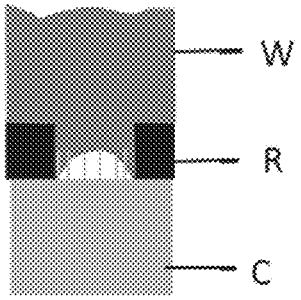

FIGS. 1 and 2 illustrate a first embodiment in accordance with the present invention. A main element of an embodiment of this invention is a small reservoir R which has an airtight upper side and a lower side which contains holes H to let water W (or another cleaning liquid) out and air in. The cloth C for cleaning is placed directly against these holes. When the reservoir R is filled, the liquid will be absorbed by the cloth C. The amount of liquid that is taken up by the cloth C depends mainly on the surface area of the holes H and the material of the cloth C. FIG. 2 shows a magnified view of the encircled area in FIG. 1, showing how the cloth C absorbs water W from the reservoir R by capillary pull/suction.

The cloth C may be made from Nylon 6. An optimized cloth has a mass per surface area that is substantially lower than 2.3 kg/m$^2$, preferably in the range of 0.2 to 1.5 kg/m$^2$ and more preferably in the range of 0.65-1.1 kg/m$^2$. This will result in a cloth that can hold less water than usual, so that an amount of water distributed by the cloth to the floor in an initial stage when a wet cloth is mounted on the floor cleaning device will not be much higher than an amount of water distributed by the cloth to the floor later on, when the cloth is continuously wetted by the water in the reservoir. A reduction of the fiber diameter from 6-9 μm to a diameter in the range of 2-9 μm, preferably 2-6 μm, and more preferably in the range between 3-4 μm will reduce the flow rate to values in the range of the desired range to match the flow rate deposited on the floor with the flow rate delivered through the holes and cloth.

The surface area that can be cleaned is only limited by the volume of the reservoir R. A wetness of the floor of approximately 2 g/m$^2$ means that for cleaning an average house of 100 m$^2$ hard floors, a reservoir of 200 ml is sufficient (rounding off and assuming that water of 1 g=1 ml). To keep the impact of water column height as small a possible a reservoir with a low height is preferred.

For the best equal distribution of liquid to the cloth C, the holes H needs to be spaced apart as close as possible or evenly distributed across the whole width of the cloth or device.

For a small mop with a width of 250 mm and holes spaced apart at 5 mm it means 45 holes are needed. For a flow of 35 ml/min with 45 holes, we need holes with a diameter of 0.3 mm.

The surface tension of the liquid influences how deep the liquid in each hole is penetrated. Using detergents in the liquid makes a big impact on the surface tension. To reduce this effect it is preferred to have a strip that is as thin as possible where the holes are placed. The thickness of the strip is preferably of the order of 0.05 to 1 mm and more preferably in the range of 0.1-0.2 mm. Test shows that a strip with thickness of 0.1 mm the effect of using detergent (other surface tension of the liquid) has no impact on the wetness. Preferably the material of the strip is hydrophilic. Preferred materials are metal or plastic coated with a hydrophilic coating. Preferably, the holes are in a protruding area of the strip.

While a strip of e.g. 0.1 mm is rather thin, to ensure sufficient strength other parts of the outlet where the holes are not present are thicker by mounting an additional material (metal, plastic) against the thin material strip either at the inside or at the outside. In the embodiments of FIGS. 6-12 below with a second reservoir R2, the walls of the reservoir R2 could be made from this thin material, with the additional material placed against this thin strip material at least at the top wall and the side walls, and preferably also at the bottom except where the strip with the holes protrudes from the remainder of the thin material.

The holes may be made by etching. The hole shape is preferably purely straight or slightly converging. If as a result of etching from both sides the hole shape also has a diverging part, an angle of the hole side to the vertical should not exceed 60°, and preferably does not exceed 30°.

Figure 3:
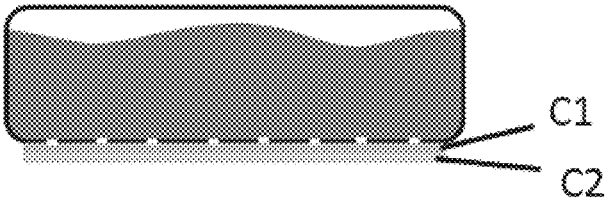
FIG. 3 shows an embodiment of the present invention having double layers of cloth.

Because the type of cloth can influence the wetness, cloths with several different layers can be used to have perfect water distribution (e.g. small soft microfibers) and also good cleaning or scrubbing performance on the floor (e.g. thick, hard, polyester fibers). FIG. 3 shows an embodiment using a multi-layer cloth having 2 layers C1, C2. Preferably, the cloth layer C2 in contact with the floor contains thick polyester fibers of diameter of 50-75 μm.

Figure 4:
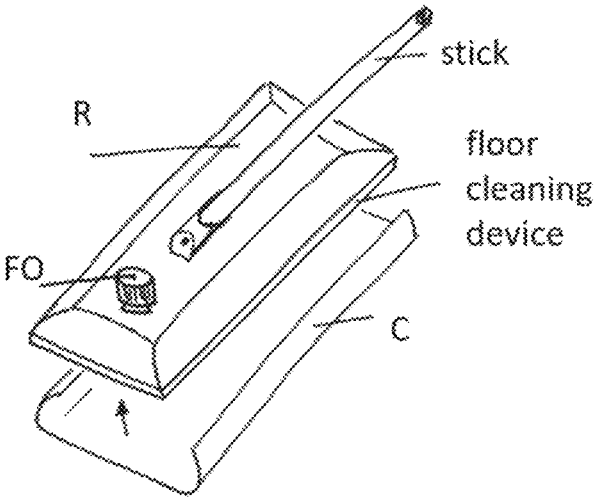
FIGS. 4 and 5 show embodiments of the present invention for use without and with vacuum cleaner, respectively.
Figure 5:
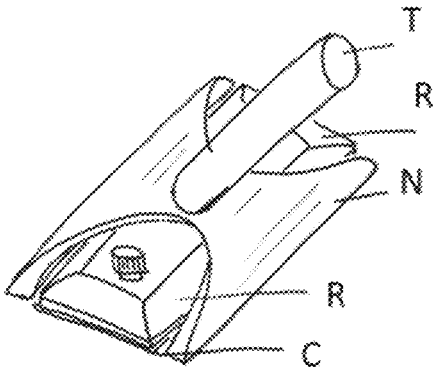

Referring to FIG. 4, showing an embodiment with reservoir R, cloth C and fill opening FO, because of the simplicity, the small dimensions and no need for additional interfaces for liquid flow or electric means, this solution is very suited to be placed directly above the floor at the bottom end of the stick of an appliance without a vacuum cleaner. With this architecture and the exact control of wetness of the floor this solution is perfectly suited to combine with vacuum nozzles, as illustrated in the embodiment of FIG. 5, which shows an embodiment having a vacuum nozzle N, reservoir R, cloth C, and tube T to canister. In that case the cloth not only remains continuously wet but also keeps clean during use especially when a suction channel is created at both sides of the cloth.

An advantageous embodiment of this invention involves a replaceable strip that has a plurality of substantially evenly spaced openings to have an evenly distribution of the liquid to the cloth and where the liquid transport out of these openings makes use of the capillary force of a wick type material. This wick type material is also the cloth for cleaning and can be washed after use.

Figure 6:
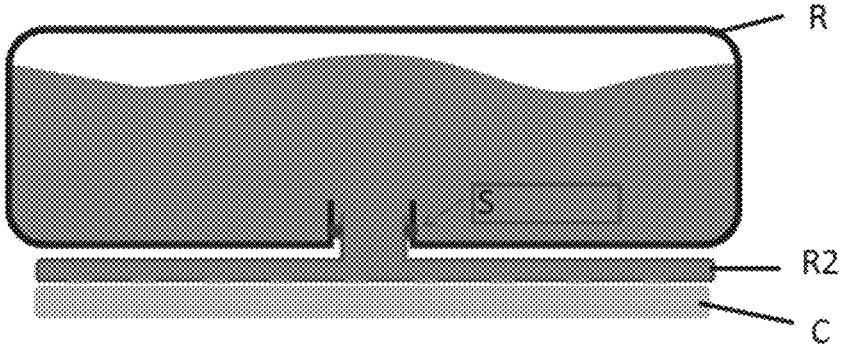
FIGS. 6 and 7 show embodiments of the present invention with replaceable strips.

It is difficult to make a liquid/air tight connection from the strip to the reservoir which is replaceable. Sealing a large surface is difficult. Therefore the strip is placed with a fixed connection in a second reservoir. This second reservoir can be made very small. Referring to FIG. 6, this second reservoir R2 is connected with a simple round sealing S to the main reservoir R. In this case the water distribution/wetness of the floor can easily be adjusted by replacing the second reservoir by another with other dimensions of the evenly spaced openings or other number of openings. When the strip in the second reservoir is clogged or broken it can easily be replaced without high cost of replacing or much effort of cleaning the full system.

Figure 7:
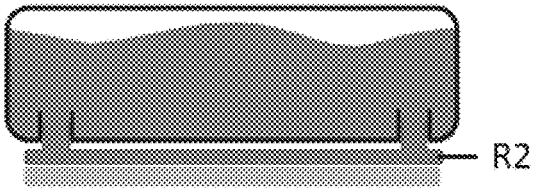
Figure 8:
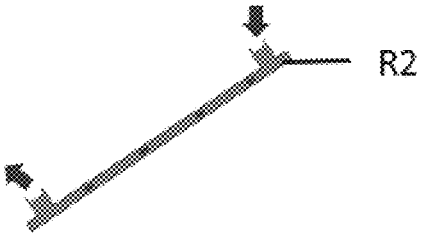
FIG. 8 shows how the replaceable strip can be flushed.

Referring to FIGS. 7 and 8, it is preferred to have two inlet openings of the second reservoir R2 to reduce the chances on air entrapment in second reservoir. The two inlet openings of the second reservoir improves cleaning of the second reservoir because it can be flushed under the tap, as shown in FIG. 8. The second reservoir R2 is the part that has the small openings which might clog. To prevent air bubbles from clogging the second reservoir R2 or from covering multiple holes, dimensions of its cross-section should be at least 3×3 mm, and preferably at least 5×5 mm. Obviously, the cross-section does not have to have a square shape; a circular shape would do as well, with a diameter of at least 4 mm and preferably 6 mm. Inlet hole(s) of the second reservoir R2 preferably have a diameter of at least 6 mm.

While in FIGS. 7 and 9-12, the ceiling of the second reservoir R2 is straight horizontal, in alternative embodiments, to easily allow any air bubbles to leave the second reservoir R2, it may be advantageous if the ceiling of the second reservoir R2 is slanted. Several options are possible, viz. that e.g. the left-hand connection to the main reservoir R is higher than the right-hand connection to the main reservoir R, or that the ceiling is wholly or partially vertically V-shaped in that the height of the second reservoir R2 at a position between the connections to the main reservoir R (which does not need to be in the middle) is lower than the height of the second reservoir R2 at the connections to the main reservoir R. An angle of the ceiling with regard to the horizontal is preferably in the range between 0.5° and 10° and more preferably in the range between 1° and 5°.

To further facilitate air bubbles from leaving the second reservoir R2, it could have a horizontal V-shape, i.e. be pointed in the forwards direction of movement of the floor cleaning device. Alternatively, the second reservoir R2 could be mounted to the main reservoir R in such a way, that e.g. the left-hand connection to the main reservoir R is positioned before the right-hand connection to the main reservoir R in the direction of movement of the floor cleaning device. Preferably an angle of the V-shape compared to a straightforward line-formed second reservoir R2, or an angle at which the second reservoir R2 is mounted is in the range of 2°-70° and more preferably in the range of 10°-30°. Preferably the connections in the second reservoir R2 to the main reservoir R have a sufficiently low radius of curvature, in order that any air bubbles can easily leave the second reservoir R2.

Figure 9:
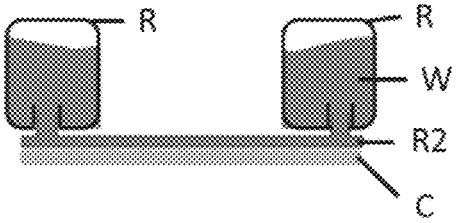
FIGS. 9 and 10 show further embodiments of the present invention with replaceable strips.
Figure 10:
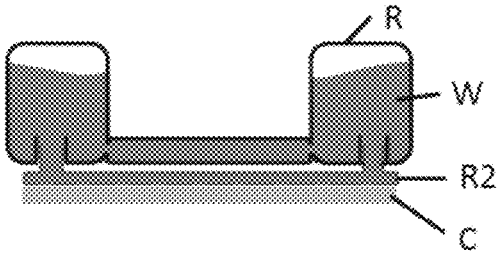

Referring to FIGS. 9 and 10, two-side filling enhances also different architectures of the first reservoir(s) R. The main element of this embodiment is a small second reservoir R2 which contains openings to let water out and air in at the lower side. This second reservoir R2 is connected via the upper sided to a first reservoir R at the lower side which has an airtight upper side. The cloth C for cleaning is placed directly against the openings of the second reservoir. The liquid W in the first reservoir R flows to the small reservoir R2 through two big holes which are present on the opposite ends of the strip or wherever desired for optimum performance. Thereafter, this water/liquid W is absorbed by the mop/cloth C through the series of holes in the strip. For the best equal distribution of liquid to the cloth, the openings needs to be spaced apart as close as possible.

In an embodiment, there are two small reservoirs R2 in parallel. A preferred embodiment would be that one small reservoir has less than 15 holes of 0.2~0.9 mm, and preferably 0.2~0.4 mm diameter while another small reservoir has between 15 and 30 holes of 0.2~0.4 mm diameter. The small reservoir with less than 15 holes has no sealing mechanism on the inlets and is therefore always "on". This setting can be used as the low setting for e.g. wooden floors. The other small reservoir with between 15 and 30 holes can be opened and closed by a sealing mechanism by activating a switch and/or valves. When the switch is opened the setting can be used as the "high" setting for e.g. tiles. The switch is situated at the outside of the reservoir and is watertight and airtight connected with a valve mechanism inside the reservoir. The mechanism activates two sealing elements which open and close the inlets to the second reservoir concerned. This embodiment would also be very useful in a context without a plurality of openings H to allow a liquid W to be extracted by means of capillary force when a mopping substrate C is mounted against the plurality of openings H.

Figure 11:
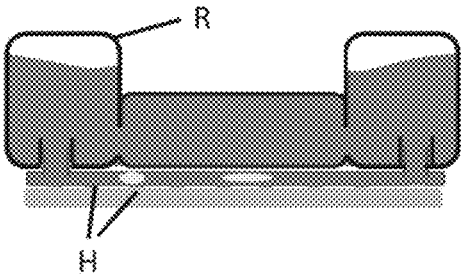
FIGS. 11 and 12 show embodiments of the present invention with different placement of holes in the strips.
Figure 12:
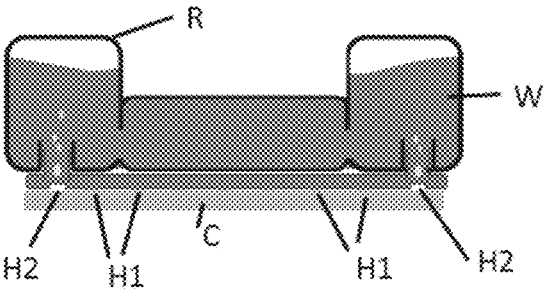

FIGS. 11 and 12 show other embodiments of the invention. As mentioned above, the water regulation can be changed by influencing the placement of holes in the base of the reservoir. The holes H can all be placed in the base evenly as shown in FIG. 11 or may be placed in a manner such that height of one hole adjacent to the other is variable i.e. there is a step on which the hole is constructed and can be seen in FIG. 12. This placement of holes can influence the wettability in that holes H1 which are in the base and come in contact with the cloth C help to dispense the liquid W while the holes H2 which are raised act as air vents. The choice and placement of the holes H1, H2 at varying height can be randomly arranged and need not be adjacent. For example, as shown in FIG. 12, only the first and last holes in the series of holes could be designed as raised holes H2 while the other holes H1 are in the base. Thus, a system that is fully closed but for the plurality of opening holes H1 in contact with the cloth C is not required. In view of surface tension, air vent holes allowing air to enter below the water level can be larger (diameter in the range of 0.2 to 0.9 mm and preferably in the range between 0.3 and 0.6 mm) than holes allowing air to enter above the water level (which should be about 0.2 mm in diameter). The air hole may have a variable controllable cross section to regulate water flow. A needle valve may do.

Another option to prevent a significant suction pressure in the tank is by increasing the pressure in the tank by e.g. a volume reduction by e.g. a membrane. For instance, a membrane open to the air but with a sufficient resistance can be introduced in the upper wall of the reservoir R. A flexible membrane can be combined with a separate air vent. A convex membrane can be operated by a consumer, e.g. by pressing the convex membrane by foot. The required volume change that the membrane should reach is preferably in the order of 0.5-10% of the air volume and more preferably in the range of 1-5% of the air volume. The material of the flexible membrane can be a rubber or other elastic materials. Note that the advantage of a flexible membrane in combination with a separate air vents is that due to air entering the reservoir R via the separate air vents the flexible membrane will move back to its original convex position so that the boost function can be operated by the consumer once more.

Another embodiment is that the volume change is permanent. This can be done also in many different options, for instance by a cylinder that is forced in the air compartment of the tank. We further include that it is also possible to regulate the suction pressure in the air in the tank to the desired levels of 3-20 mbar, preferably 6-12 mbar via a direct contact with the air. When this contact has a sufficient resistance the system is open to the air but still it is possible to ensure that the suction pressure is at the required levels of 3-20 mbar, preferably 6-12 mbar. An embodiment is for instance a membrane with a sufficient air resistance.

Preferably, to ensure that the under-pressure in the reservoir R does not become too high, the reservoir R is provided with an air valve that opens when an under-pressure in the reservoir R exceeds a first threshold of e.g. 25 mbar (preferably 20 mbar, even more preferably 15 mbar), and that closes when the under-pressure falls below a second threshold of e.g. 0 mbar (preferably 6 mbar).

To prevent air from filling the holes H1, it appeared advantageous if the holes are shaped such that from outside to inside, they first have a relatively narrow diameter of about 0.3 mm for the thickness of a bottom strip of about 0.1 mm, and then a relatively wide diameter of at least 1.5 to 2 times the relatively narrow diameter; this relatively wide diameter would be about 15-60% of a cross section of the second reservoir R2.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. An opening may be filled with a wick. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A liquid containing system for a floor cleaning device, the liquid containing system comprising:

a first reservoir adapted to contain liquid; and a second reservoir, smaller than the first reservoir, wherein the second reservoir is provided with at least one liquid and air-tight inlet connection on a top surface thereof, wherein the second reservoir comprises a replaceable reservoir adapted to be replaceably coupled, at the top surface of the second reservoir, to a bottom surface of the first reservoir via the at least one liquid and air-tight inlet connection to facilitate a flow of the liquid from the first reservoir into the second reservoir, the second reservoir further having a bottom surface provided with an outlet having a plurality of openings to allow the liquid in the second reservoir to be extracted by means of capillary force in response to a mopping substrate being mounted against the plurality of openings, wherein responsive to the second reservoir being coupled to the first reservoir, the first reservoir and second reservoir together are substantially closed but for the plurality of openings, wherein a diameter of the openings comprises a diameter selected from the group consisting of (i) in a range of 0.2 to 0.9 mm, (ii) in a range of 0.2 to 0.4 mm, and (iii) 0.3 mm, and wherein the outlet comprises first openings arranged to be in direct contact with a mopping substrate, and at least one second opening operative as an air vent which is at a height elevation raised in comparison with an elevation of the first openings.

2. A liquid containing system as claimed in claim 1, wherein the at least one liquid and air-tight inlet connection comprises a single connection, centrally located on the top surface of the second reservoir, for being connected at a corresponding location of the bottom surface of the first reservoir.

3. A liquid containing system as claimed in claim 1, wherein the at least one liquid and air-tight inlet connection comprises two connections, each connection being located on the top surface of the second reservoir at opposite ends thereof, for being connected at a corresponding location of the bottom surface of the first reservoir.

4. A liquid containing system as claimed in claim 1, wherein the second reservoir is one selected from a plurality of different second reservoirs having dimensions of evenly spaced openings different among corresponding openings of individual ones of the plurality of different second reservoirs or a number of openings different from among a number of openings of respective individual ones of the plurality of different second reservoirs, further wherein at least one of the different second reservoirs being connected to the first reservoir via at least one liquid and air-tight connection that can be opened or closed.

5. A liquid containing system as claimed in claim 1, wherein the at least one liquid and air-tight connection between the second reservoir (R2) and the first reservoir (R) has a diameter that is at least 6 mm.

6. A liquid containing system as claimed in claim 1, wherein the liquid containing system further comprises a flexible membrane coupled to the first reservoir, wherein the flexible membrane is operable as a movable part that can be operated to obtain a volume reduction within a volume of the first reservoir of the liquid containing system.

7. A liquid containing system as claimed in claim 1, further comprising an air valve adapted to open in response to an under-pressure in the first and second reservoirs of the liquid containing system exceeding a first threshold, and adapted to close in response to the under-pressure falling below a second threshold.

8. A liquid containing system as claimed in claim 1, further comprising a mopping substrate, wherein the mopping substrate has a mass per surface area selected from the group consisting of (i) lower than 2.3 $kg/m^2$, (ii) in a range of 0.2 to 1.5 $kg/m^2$, and (iii) in a range of 0.65-1.1 $kg/m^2$.

9. A liquid containing system as claimed in claim 1, further comprising a mopping substrate provided with fibers, each fiber having a fiber diameter selected from the group consisting of (i) in a range of 2-9 μm, (ii) in a range of 2-6 μm, and (iii) in a range between 3-4 μm.

10. A liquid containing system as claimed in claim 1, wherein the plurality of openings comprise etched openings in a strip having a thickness selected from the group consisting of (i) in a range of 0.05 to 1 mm, and (ii) in a range of 0.1 to 0.2 mm.

11. A floor cleaning device comprising a liquid containing system as claimed in claim 1.

* * * * *